US010724221B2

(12) United States Patent
Yoshida et al.

(10) Patent No.: US 10,724,221 B2
(45) Date of Patent: Jul. 28, 2020

(54) SANITARY WASHING DEVICE

(71) Applicant: TOTO LTD., Kitakyushu-shi, Fukuoka (JP)

(72) Inventors: Takakuni Yoshida, Kitakyushu (JP); Masayuki Mochita, Kitakyushu (JP); Yoshihiro Koto, Kitakyushu (JP); Takeshi Yamakawa, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/665,534

(22) Filed: Aug. 1, 2017

(65) Prior Publication Data

US 2018/0058054 A1 Mar. 1, 2018

(30) Foreign Application Priority Data

Aug. 24, 2016 (JP) ..... 2016-163546

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/443–448, 420.1–420.5
See application file for complete search history.

(56) References Cited

U.S. PATENT DOCUMENTS 4,370,764 A * 2/1983 Ando ..... E03D 9/08 4/420.2
4,559,964 A * 12/1985 Yamaguchi ..... A61M 3/025 137/107
5,666,672 A * 9/1997 Birsel ..... A47K 13/12 4/236
2010/0125941 A1* 5/2010 Shin ..... E03D 9/08 4/443
2011/0030133 A1* 2/2011 Morotomi ..... E03D 9/08 4/443
2011/0072572 A1 3/2011 Hashimoto et al.

FOREIGN PATENT DOCUMENTS

JP 22573 * 1/1990
JP 514279 * 2/1993
JP 782778 * 3/1995
KR 10-0984231 B1 9/2010

OTHER PUBLICATIONS

Machine Translation for JP782778.*
Machine Translation for JP514279.*
Translation of JP 2-2573. (Year: 2019).*

* cited by examiner

*Primary Examiner* — Erin Deery
(74) *Attorney, Agent, or Firm* — Pearne & Gordon LLP

(57) ABSTRACT

According to one embodiment, a sanitary washing device includes a nozzle being capable of discharging water toward a human body private part, a solenoid valve provided on a water channel between a water supply source and the nozzle, the solenoid valve opening and shutting the water channel, and a pressure regulator valve provided on the water channel between the solenoid valve and the nozzle, the pressure regulator valve regulating a pressure of water flowing through the water channel. At least a portion of the pressure regulator valve is disposed in a range to which the solenoid valve is projected from upward to downward.

5 Claims, 5 Drawing Sheets

SANITARY WASHING DEVICE

CROSS-REFERENCE TO RELATED APPLICATIONS

This application is based upon and claims the benefit of priority from Japanese Patent Application No. 2016-163546, filed on Aug. 24, 2016; the entire contents of which are incorporated herein by reference.

FIELD

Embodiments described herein relate generally to a sanitary washing device.

BACKGROUND

There is a sanitary washing device, which water is supplied from a water supply source such as a waterworks and discharged to a human body private part from a nozzle. In this sanitary washing device, a pressure regulator valve is provided in order to adjust a water pressure of a water channel from the water supply source to the nozzle as disclosed in, for example, JP 2001-98622 A(Kokai).

Conventionally, the pressure regulator valve has been disposed above a solenoid valve. The solenoid valve is designed and manufactured so as not to be damaged in a normal use. On the other hand, the pressure regulator valve may be damaged by degradation accompanied with the normal use. If the pressure regulator valve is damaged, the water flows out of the pressure regulator valve. In the conventional arrangement, the water flowing out of the pressure regulator valve strikes the lower solenoid valve. Then the spattered water may adhere on other parts in the sanitary washing device. Thus the operation of the parts has a possibility to be influenced.

The invention has been made based on the recognition of such a problem. The object of the invention is to provide the sanitary washing device which is capable of reducing the influence to the other parts due to the flowing out water even if the pressure regulator valve is damaged and the water flows out.

SUMMARY

A sanitary washing device according to an embodiment includes a nozzle being capable of discharging water toward a human body private part, a solenoid valve provided on a water channel between a water supply source and the nozzle, the solenoid valve opening and shutting the water channel, and a pressure regulator valve provided on the water channel between the solenoid valve and the nozzle, the pressure regulator valve regulating a pressure of water flowing through the water channel. At least a portion of the pressure regulator valve is disposed in a range to which the solenoid valve is projected from upward to downward.

DETAILED DESCRIPTION

Figure 1:
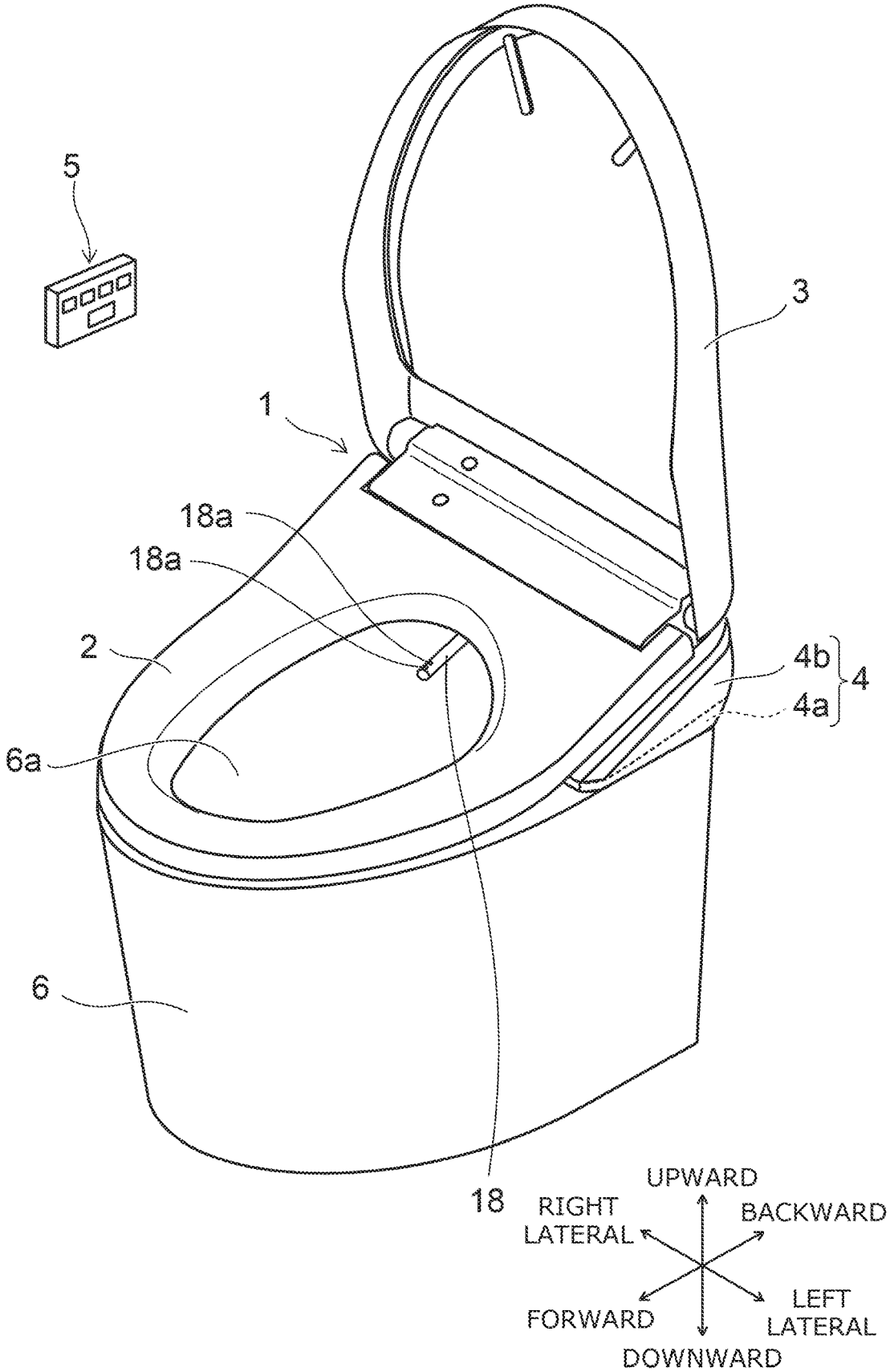
FIG. 1 is a perspective view showing a toilet apparatus including a sanitary washing device according to an embodiment.

The first invention relates to a sanitary washing device. The sanitary washing device includes a nozzle being capable of discharging water toward a human body private part, a solenoid valve provided on a water channel between a water supply source and the nozzle, the solenoid valve opening and shutting the water channel, and a pressure regulator valve provided on the water channel between the solenoid valve and the nozzle, the pressure regulator valve regulating a pressure of water flowing through the water channel. At least a portion of the pressure regulator valve is disposed in a range to which the solenoid valve is projected from upward to downward.

According to the sanitary washing device, even when the pressure regulator valve is damaged and the water flows out of the pressure regulator valve, the water is difficult to strike the solenoid valve. Therefore, the water spatter to other parts in the sanitary washing device can be furthermore suppressed.

The second invention relates to the sanitary washing device of the first invention, and the sanitary washing device further includes a case plate. The nozzle, the solenoid valve, and the pressure regulator valve are placed on the case plate. A drainage path is formed on an upper surface of the case plate from a portion of the pressure regulator valve placed toward the toilet bowl.

According to the sanitary washing device, the water flowing out of the pressure regulator valve is drained effectively out of the case plate. Therefore, the water can be suppressed from collecting on the case plate.

The third invention relates to the sanitary washing device of the first or second invention, and a valve body of the pressure regulator valve is movable in a horizontal direction.

According to the sanitary washing device, the heights of the solenoid valve and the pressure regulator valve can be suppressed from increasing when the pressure regulator valve is provided under the solenoid valve. Therefore, the height of the sanitary washing device can be suppressed from increasing. This unit becomes possible to be downsized when the solenoid valve and the pressure regulator valve are unitized.

The fourth invention relates to the sanitary washing device of the third invention, and the pressure regulator valve includes a diaphragm displacing depending on a pressure of water flowing through the pressure regulator valve, a drainage aperture is formed in the pressure regulator valve on an atmosphere side of the diaphragm, and the drainage aperture is oriented downward.

According to the sanitary washing device, when the pressure regulator valve is damaged and the water flows out of the pressure regulator valve from the drainage aperture of the pressure regulator valve, it becomes furthermore difficult for the water to strike the solenoid valve. Therefore, the water spatter to other parts in the sanitary washing device can be furthermore suppressed.

The fifth invention relates to the sanitary washing device of the third or fourth invention, and water flows in the pressure regulator valve along a vertical direction, and water flows out of the pressure regulator valve along the horizontal direction.

According to the sanitary washing device, the heights of the solenoid valve and the pressure regulator valve can be suppressed from increasing. Therefore, the height of the sanitary washing device can be suppressed from increasing. This unit becomes possible to be downsized when the solenoid valve and the pressure regulator valve are unitized.

The sixth invention relates to the sanitary washing device of one of the third to fifth inventions, and the sanitary washing device further includes a safety valve provided on the water channel between the pressure regulator valve and the nozzle. The safety valve relieves a water pressure escape to outside when the water pressure not less than a prescribed value being applied, and at least a portion of the pressure regulator valve being disposed in a range to which the safety valve is projected from upward to downward.

According to the sanitary washing device, the heights of the solenoid valve, the pressure regulator valve, and the safety valve can be suppressed from increasing. Therefore, the height of the sanitary washing device can be suppressed from increasing. This unit becomes possible to be downsized when the solenoid valve, the pressure regulator valve, and the safety valve are unitized.

Various embodiments of the invention will be described hereinafter with reference to the accompanying drawings. In the figures, the same reference numbers are applied to the same constitutional elements, and detailed description will not be repeated as appropriate.

FIG. 1 is a perspective view showing a toilet apparatus including a sanitary washing device according to an embodiment.

As shown in FIG. 1, the toilet apparatus includes a western-style sit-down toilet bowl 6 (hereinafter, for convenience of description, simply referred to as "toilet bowl") and a sanitary washing device 1 provided thereon. The sanitary washing device 1 includes a toilet seat 2, a toilet lid 3 and a casing 4. The toilet seat 2 and the toilet lid 3 are axially supported to the casing 4 freely openable, respectively.

In the following description of the embodiment, "upward", "downward", "forward", "backward", "rightward", and "leftward" are used. These directions are viewed from a user sitting on the toilet seat 2 as shown in FIG. 1.

The casing 4 includes a case plate 4*a* and a cover 4*b*. The case plate 4*a* is placed on an upper surface backward the toilet seat. The cover 4*b* covers the case plate 4*a*. Since the case plate 4*a* is covered by the cover 4*b* in the example shown in FIG. 1, the case plate 4*a* is represented by a broken line.

A nozzle 18 washing a "bottom" of the user sitting on the toilet seat 2 is incorporated inside the casing 4. A room entry sensor, a human body sensor, and a seating sensor or the like are provided on the casing 4, for example. The room entry sensor senses entry of the user into the toilet room. The human body sensor senses the user forward the toilet seat 2. The seating sensor senses seating of the user onto the toilet seat 2.

The user can advance the nozzle 18 into a bowl 6*a* of the toilet bowl 6, and retract from the bowl 6*a* by operating an operation part 5 such as a remote controller. In the sanitary washing device 1 shown in FIG. 1, a state of the nozzle 18 advanced into the bowl 6*a* is shown. A water discharge port 18*a* is provided at a distal end portion of the nozzle 18. The nozzle 18 can wash the "bottom" of the user sitting on the toilet seat 2 by spraying water or warm water from the water discharge port 18*a*.

A toilet seat heater, warm air drying function, a deodorizing unit, an indoor heating unit or the like may be appropriately provided in the casing 4. The toilet seat heater heats up the toilet seat 2. The warm air drying function blows warm air toward the "bottom" of the user sitting on the toilet seat 2 to dry.

Flow of water in the sanitary washing device 1 will be described with reference to FIG. 2.

Figure 2:
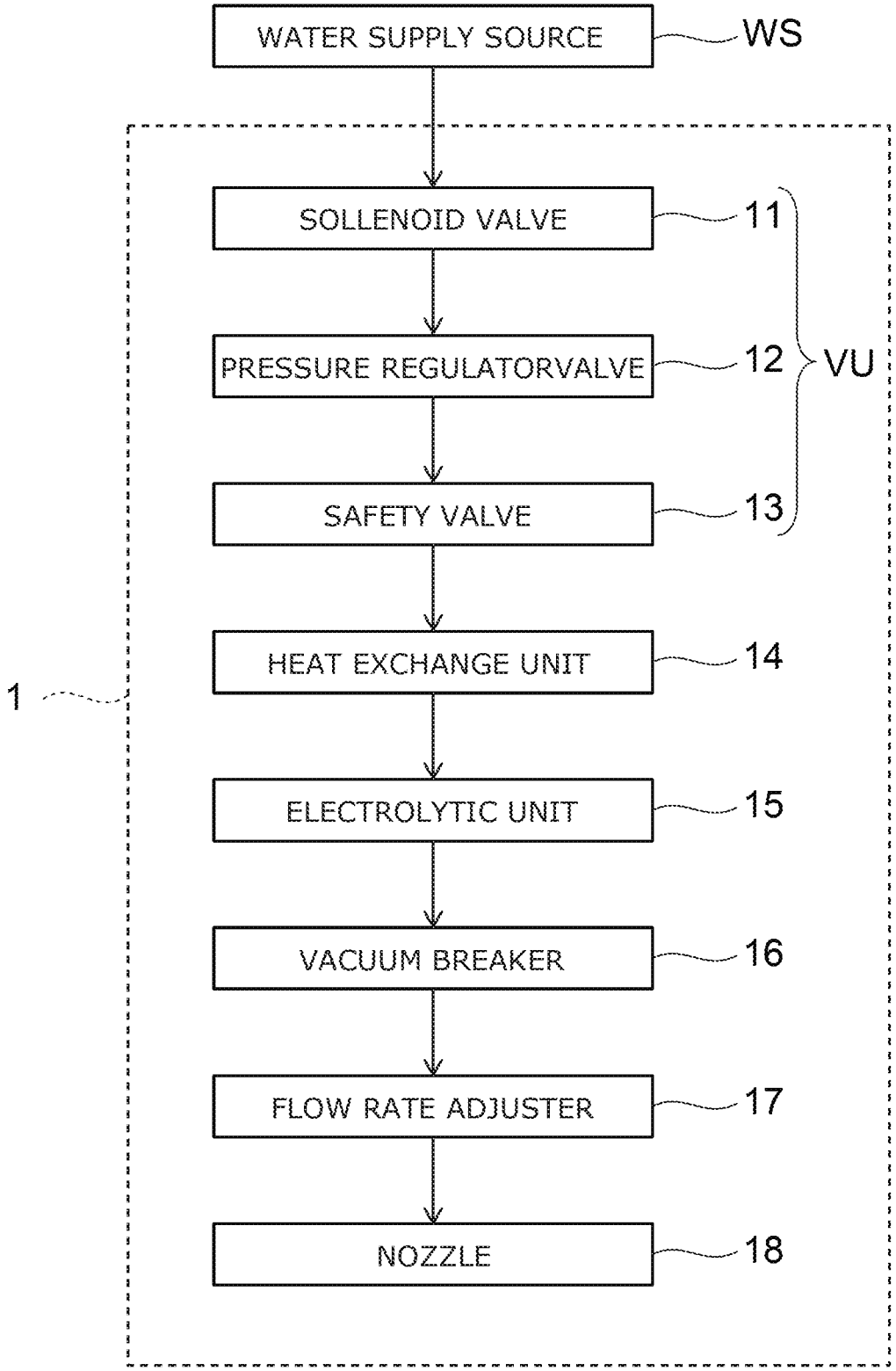
FIG. 2 is a block diagram illustrating a water channel in the sanitary washing device according to the embodiment.

FIG. 2 is a block diagram illustrating a water channel in the sanitary washing device according to the embodiment.

The water channel of the sanitary washing device 1 is connected to the water supply source WS such as a waterworks and a water storage tank. As shown in FIG. 2, on the water channel between the water supply source WS and the nozzle 18, a valve unit VU, a heat exchange unit 14, an electrolytic unit 15, vacuum breaker 16, and a flow rate adjuster 17 are provided toward the nozzle 18 from the water supply source WS side. The valve unit VU includes a solenoid valve 11, a pressure regulator valve 12, and a safety valve 13.

The solenoid valve 11 switches a state in which the water is supplied toward a downstream side and a state in which supply of the water is stopped by opening and shutting the water channel. The pressure regulator valve 12 adjusts the pressure or the water supplied from an upstream side so as to be a prescribed pressure on the downstream side. If the pressure of the flowing water is higher than the prescribed value, the safety valve 13 opens a valve body provided inside. Thereby, the water is drained outside the safety valve 13, and the water pressure is relieved to the outside. The heat exchange unit 14 includes a heater, and heats the water supplied to the heat exchange unit 14 to produce the warm water.

The electrolytic unit 15 produces a liquid (functional water) including hypochlorous acid from tap water by electrolyzing the tap water which flows inside, for example. When the water flow in the vacuum breaker 16 is stopped, the vacuum breaker 16 opens a suction port to take in air into the water channel, and accelerates water drainage on the downstream side of the vacuum breaker 16. The flow rate adjuster 17 adjusts water force (flow rate). Thereby, the force of water discharged from the nozzle 18 is adjusted.

The water channel shown in FIG. 2 is one example. The constitutional components provided between the valve unit VU and the nozzle 18 are possible to be appropriately changed depending on functions included in the sanitary washing device 1.

The valve unit VU including the solenoid valve 11, the pressure regulator valve 12, and the safety valve 13 will be described specifically.

Figure 3:
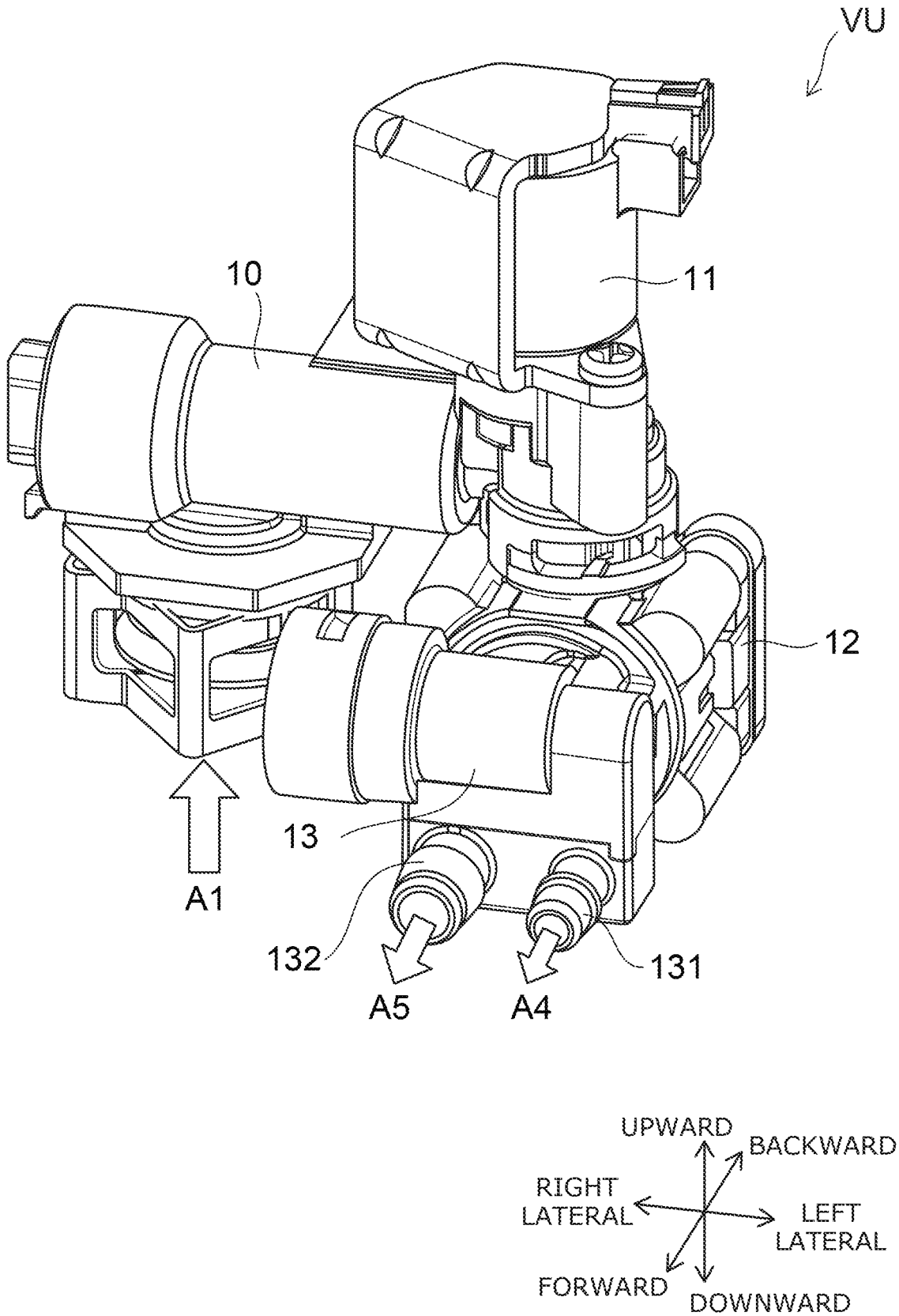
FIG. 3 is a perspective view showing a valve unit of the sanitary washing device according to the embodiment.

FIG. 3 is a perspective view showing a valve unit of the sanitary washing device according to the embodiment.

Figure 4:
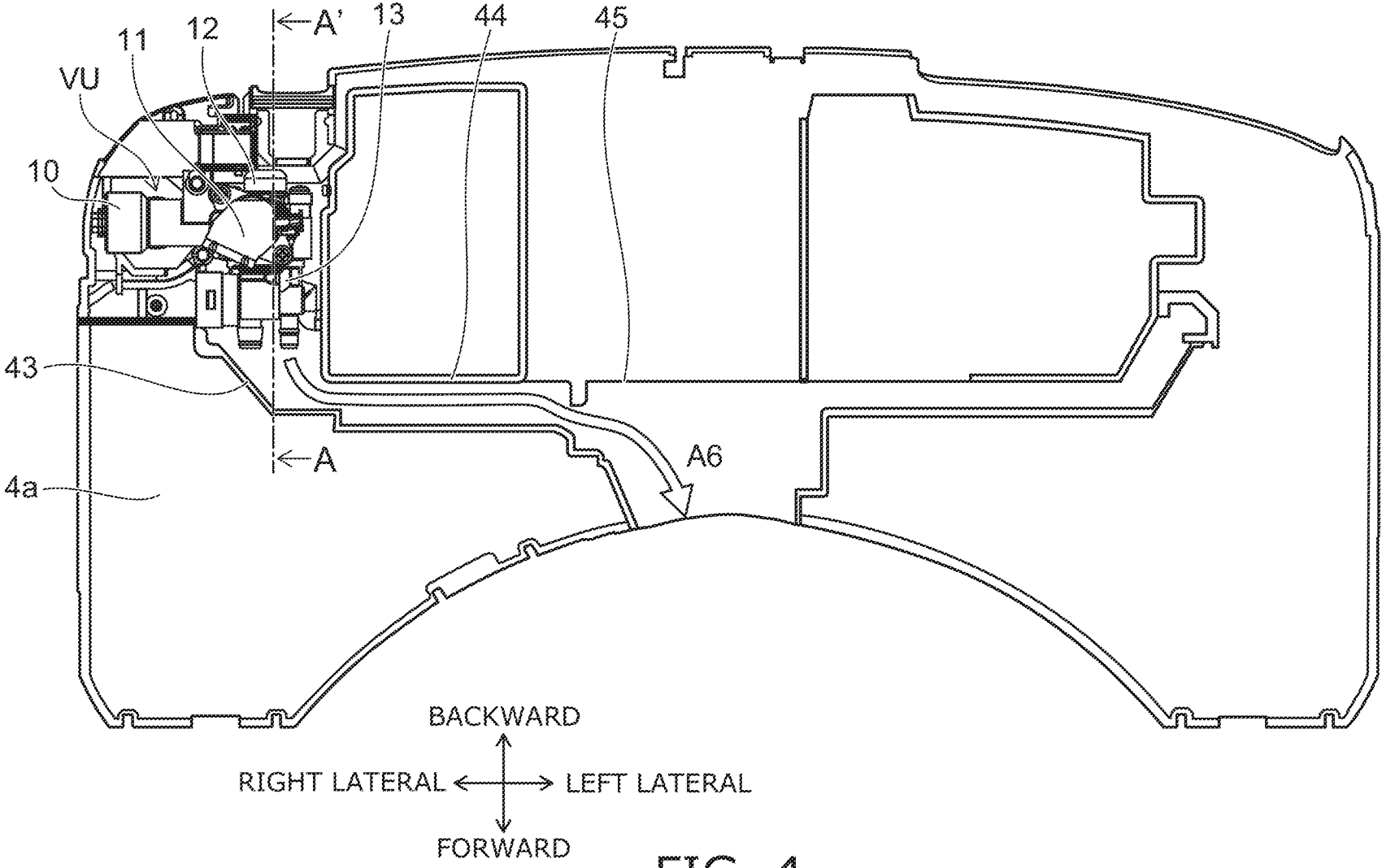
FIG. 4 is a plan view showing the valve unit and a case plate of the sanitary washing device according to the embodiment.

FIG. 4 is a plan view showing the valve unit and a case plate of the sanitary washing device according to the embodiment.

Figure 5:
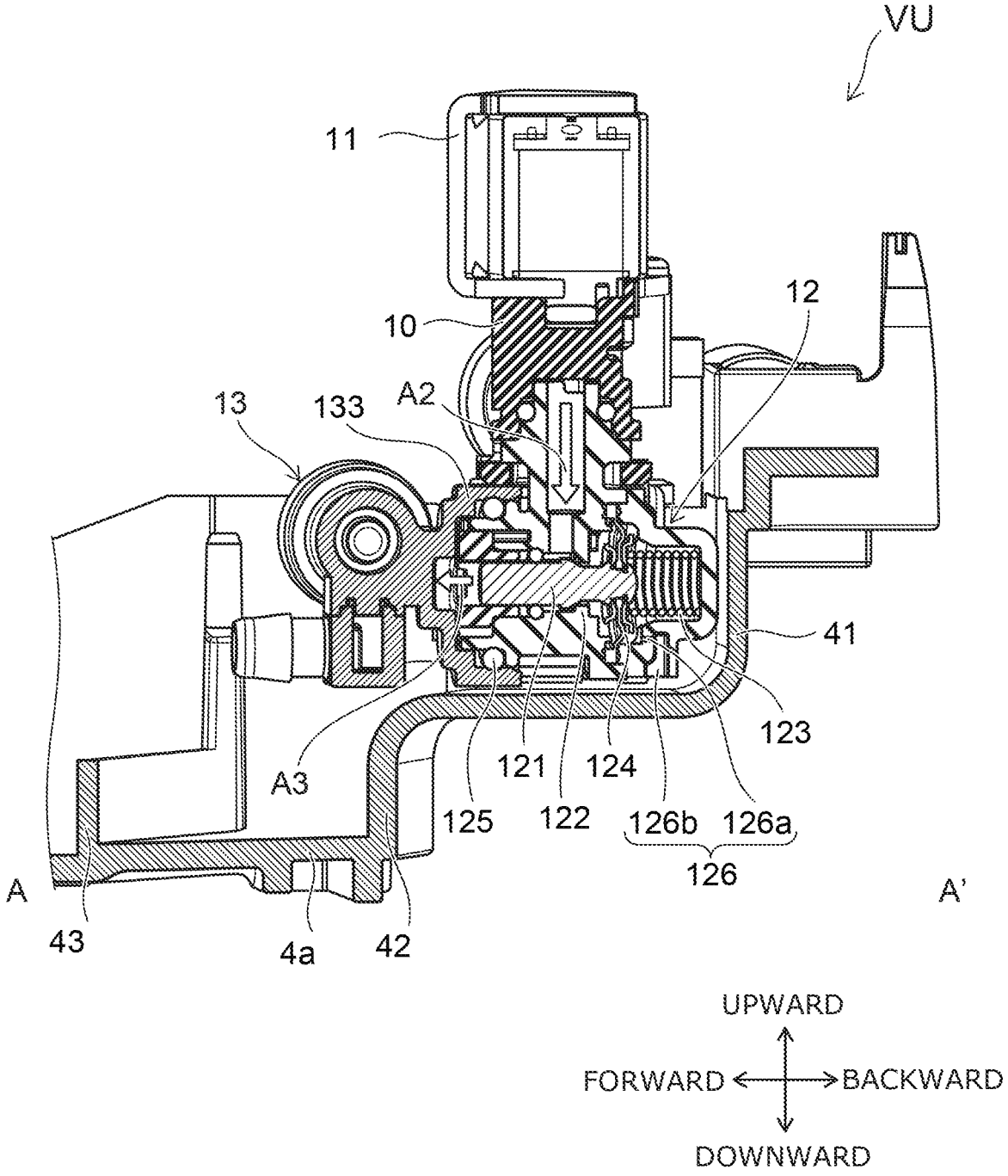
FIG. 5 is a cross-sectional view in A-A' line of FIG. 4.

FIG. 5 is a cross-sectional view in A-A' line of FIG. 4.

The flow of water in the valve unit VU will be described.

A pipe 10 including a strainer and a check valve is connected between the valve unit VU and the water supply source WS. The water supplied from the water supply source WS flows into the pipe 10 as shown by an arrow A1 in FIG. 3. The water flowing in the pipe 10 passes through the solenoid valve 11 of the valve unit VU, and flows into the pressure regulator valve 12 as shown by an arrow A2 in FIG. 5. After that, the pressure adjusted water flows into the safety valve 13 as shown by an arrow A3. The water flowing into the safety valve 13 flows out from an outflow port 131 as shown by an arrow A4 in FIG. 3, and flows toward the heat exchange unit 14. If a pressure not less than the prescribed value is applied to the safety valve 13, and the valve body of the safety valve 13 is opened, the water flows out of the outflow port 132 as shown by an arrow A5. For example, a tube not illustrated is connected to the outflow port 132. The water flowing out of the outflow port 132 is introduced to the bowl 6*a* of the toilet bowl 6 and is thrown away.

The structure of the valve unit VU will be described.

As shown in FIG. 4, the valve unit VU is placed on the case plate 4*a*. As shown in FIG. 5, the pressure regulator valve 12 includes a valve body 121, a valve seat 122, a coil spring 123, a diaphragm 124, and a seal.

The valve body 121 is configured to be movable in a horizontal direction (for example, front-back direction). The valve seat 122 is configured to abut with an outer circumferential portion of the valve body 121 when the valve body 121 moves in the horizontal direction. The inner surface of the diaphragm 124 faces the water channel. The outer surface faces an atmospheric space. The diaphragm 124 is biased toward an inner surface side from an outer surface side by the coil spring 123. The diaphragm 124 displaces depending on a water pressure on an inflow side. A gap between the valve body 121 and the valve seat 122 changes. Thus a water pressure on an outflow side is adjusted.

A drainage aperture 126 formed of an aperture 126*a* and an aperture 126*b* is formed on an atmosphere side of the diaphragm 124, for example. The aperture 126*a* is formed along the horizontal direction. The aperture 126*b* is formed along the perpendicular direction. The aperture 126*a* is communicated with the space outside the pressure regulator valve 12. The seal is provided between a flange 133 of the safety valve 13 and a structure of the pressure regulator valve 12 so that the water on the inflow side does not flow into the safety valve 13 directly.

A positional relationship between the respective constitutional components in the valve unit VU will be described.

As shown in FIG. 3 and FIG. 5, the solenoid valve 11 is disposed on a portion of the pipe 10. At least a portion of the pressure regulator valve 12 and at least a portion of the safety valve 13 are disposed immediately below the solenoid valve 11. In other words, at least a portion of the pressure regulator valve 12 and at least a portion of the safety valve 13 are disposed in a range to which the solenoid valve 11 is projected from upward to downward. The pressure regulator valve 12 and the safety valve are disposed in the horizontal direction (for example, front-back direction).

As described above, the diaphragm 124 displaces depending on the water pressure on the inflow side, and has a possibility of damage due to a time degradation and instantaneous application of a large water pressure. When the diaphragm 124 is damaged, the leaked water to the atmosphere side flows out of the pressure regulator valve 12 through the aperture 126*a* and the aperture 126*b*.

In the valve unit VU of the sanitary washing device 1 according to the embodiment, at least a portion of the pressure regulator valve 12 is disposed in the range to which the solenoid valve 11 is projected from upward to downward. Even if the diaphragm 124 is damaged and the water flows out of the pressure regulator valve 12, the water flows on the case plate 4*a* without striking the solenoid valve 11. Therefore, even if the pressure regulator valve 12 is damaged, the water spatter to other parts in the sanitary washing device 1 can be suppressed. A possibility of damage or the like of other parts due to adhesion of the water can be reduced.

The height of the solenoid valve 11, the pressure regulator valve 12, and the safety valve 13 can be suppressed from increasing by disposing at least a portion of the safety valve 13 in the range to which the solenoid valve 11 is projected from upward to downward. As a result, the height of the sanitary washing device 1 can be suppressed from increasing. An area occupied by the valve unit VU in which the solenoid valve 11, the pressure regulator valve 12 and the safety valve 13 are unitized can be small in the case plate 4*a*. As a result, the valve unit VU is possible to be downsized.

As shown in FIG. 5, the drainage aperture 126 is desired to be oriented downward. In other words, the aperture communicating the space inside the pressure regulator valve 12 (atmosphere side of the diaphragm 124) with the outside space is desired to have an opening facing the outside space being oriented downward. According to the configuration, when the pressure regulator valve 12 is damaged and the water flows out of the pressure regulator valve 12, it becomes furthermore difficult for the water to strike the solenoid valve 11. Therefore, the water spatter to other parts in the sanitary washing device 1 can be furthermore suppressed.

As shown in FIG. 5, the case plate 4*a* has a bent portion 41 and a bent portion 42 formed. The bent portion 41 is bent upward in the backward of the drainage aperture 126. The bent portion 42 is bent downward in the forward of the drainage aperture 126. The water flowing out of the pressure regulator valve 12 from the drainage aperture 126 flows toward the bent portion 42 on an upper surface of the case plate 4*a*. A protrusion 43 is further formed forward the bent portion 42. The water which flowed down from the bent portion 42 is dammed by the protrusion 43.

The bent portion 42 is provided to communicate with a bent portion 44 and a bent portion 45 shown in FIG. 4. A slope is formed on the upper surface of the case plate 4*a* so that the water flows from the backward to the frontward and from the rightward and the leftward toward the center. The water which flows between the bent portion 42 and the protrusion 43 flows between the protrusion 43 and the bent portion 44 and between the protrusion 43 and the bent portion 45 as shown by an arrow A6 in FIG. 4. Then the water is drained outside the casing 4 to be thrown away to the bowl 6*a*.

In other words, a drainage path for introducing the water flowing out of the drainage aperture 126 of the pressure regulator valve 12 to the toilet bowl 6 is formed on the upper surface of the case plate 4*a*. According to the structure like this, the water flowing out of the drainage aperture 126 is drained effectively out of the case plate 4*a*, and the water can be suppressed from collecting on the case plate 4*a*.

In the example shown in FIG. 3 and FIG. 4, the protrusion 43 and the bent portions 42, 44, and 45 form the drainage path. If the water can be introduced outside the casing 4 from the position where the pressure regulator valve 12 is placed, the configuration of the drainage path is not limited thereto. For example, a depression may be formed in the upper surface of the case plate 4*a* so as to introduce the water from the position of the pressure regulator valve 12 placed to the outside of the casing 4.

The valve body of the pressure regulator valve 12 is desired to be movable in the horizontal direction (for example, front-back direction). In a direction along which the valve body is movable, the space for the valve body 121 to be movable and the space for the diaphragm 124 to be displaced are needed. Therefore, the pressure regulator valve 12 generally has a dimension of the valve body 121 in the direction along which the valve body is movable longer than a dimension of the valve body 121 in a direction perpendicular to direction along which the valve body is movable. By setting the direction along which the valve body 121 of the pressure regulator valve 12 is movable to be in the horizontal direction, even when the solenoid valve 11 is provided immediately above the pressure regulator valve 12, the heights of the solenoid valve 11 and the pressure regulator valve 12 can be furthermore suppressed from increasing. As a result, the height of the sanitary washing device 1 can be suppressed from increasing. It is possible to suppress the increase of the height of the valve unit VU and to downsize the valve unit VU furthermore.

It is desired that the water flows in the pressure regulator valve 12 along a vertical direction perpendicular to the direction along which the valve body 121 is movable and the water flows out along the horizontal direction. This is because of the following reason.

In the sanitary washing device 1 according to the embodiment, at least a portion of the pressure regulator valve 12 is provided immediately below the solenoid valve 11. Therefore, in the case where the water is flown in the pressure regulator valve 12 along the horizontal direction, a length of the pipe and a length of the hose for causing the water to flow into the pressure regulator valve 12 from the solenoid valve 11 are longer compared with the case where the water flows in immediately below (vertical direction).

The safety valve 13 is arranged with the pressure regulator valve 12 in the horizontal direction (for example, front-back direction). Therefore, in the case where the water is flown out of the pressure regulator valve 12 along the vertical direction, a length of the pipe and a length of the hose for causing the water to flow into the safety valve 13 from the pressure regulator valve 12 are longer compared with the case where the water is flown out in the horizontal direction (forward).

That is, by causing the water to flow in the pressure regulator valve 12 along the vertical direction and causing the water to flow out of the pressure regulator valve 12 in the horizontal direction, the heights of the solenoid valve 11 and the pressure regulator valve 12 can be suppressed from increasing. As a result, the height of the sanitary washing device 1 can be suppressed from increasing. It becomes possible to downsize the valve unit VU furthermore.

Although the embodiments of the invention are described above, the invention is not limited to these descriptions. Any design variation in the above embodiments appropriately made by a person skilled in the art is also encompassed within the scope of the invention as long as they fall within the spirit of the invention. For example, the shape, the size, the material, the disposition, the placement configuration or the like of the respective components included in the solenoid valve 11, the pressure regulator valve 12, the safety valve 13 or the like are not limited to illustrations and can be changed appropriately.

The components included in the embodiments described above can be combined to the extent of technical feasibility and the combinations are included in the scope of the invention to the extent that the feature of the embodiments is included.

What is claimed is:

1. A sanitary washing device comprising:

a nozzle being capable of discharging water toward a human body ano-genital region;

a solenoid valve provided on a water channel between a water supply source and the nozzle, the solenoid valve opening and shutting the water channel; and a pressure regulator valve provided on the water channel between the solenoid valve and the nozzle, the pressure regulator valve regulating a pressure of water flowing through the water channel, a valve body of the pressure regulator valve being movable in a horizontal direction, the pressure regulator valve including a diaphragm being displaced depending on a pressure of water flowing through the pressure regulator valve, wherein a drainage aperture communicating a first space inside the pressure regulator valve and in an atmospheric side of the diaphragm with a second space outside the pressure regulator valve is formed in the pressure regulator valve, and wherein the drainage aperture is provided such that in a case where the diaphragm is damaged, water leaked to the first space flows out of the pressure regulator valve through the drainage aperture, and the drainage aperture is oriented downwardly, at least a portion of the pressure regulator valve being disposed immediately below the solenoid valve, wherein the drainage aperture penetrates a wall of the pressure regulator valve, and the drainage aperture includes a first opening facing the first space, a second opening facing the second space, and a flow path between the first opening and the second opening, the flow path being not exposed to the second space.

2. The sanitary washing device according to claim 1, further comprising:

a case plate, the nozzle, the solenoid valve, and the pressure regulator valve being placed on the case plate, a drainage path being formed on an upper surface of the case plate, the drainage path introducing water flowing out of the drainage aperture of the pressure regulator valve to a toilet bowl.

3. The sanitary washing device according to claim 1, wherein water flows in the pressure regulator valve along a vertical direction, and water flows out of the pressure regulator valve along the horizontal direction.

4. The sanitary washing device according to claim 1, further comprising:

a safety valve provided on the water channel between the pressure regulator valve and the nozzle, wherein the safety valve relieves water pressure when the water pressure is higher than a prescribed value, at least a portion of the safety valve being disposed immediately below the solenoid valve.

5. The sanitary washing device according to claim 1, wherein the pressure regulator valve further includes a coil spring for biasing the diaphragm, and the second opening is oriented downwardly and is immediately below the coil spring.

* * * * *